United States Patent [19]

Neff

[11] Patent Number: 4,907,963

[45] Date of Patent: Mar. 13, 1990

[54] BURNER BRACKET

[75] Inventor: Glenn C. Neff, Altamonte Springs, Fla.

[73] Assignee: Combustion Tec, Inc., Orlando, Fla.

[21] Appl. No.: 217,361

[22] Filed: Jul. 11, 1988

[51] Int. Cl.[4] ..... F23C 5/06; B05B 15/06

[52] U.S. Cl. ..... 431/189; 431/186; 239/281; 239/283; 248/278

[58] Field of Search ..... 431/186, 189; 239/265, 239/280.5, 281, 283; 248/200, 274, 278, 287, 542

[56] References Cited

U.S. PATENT DOCUMENTS

| | | | |
|---|---|---|---|
| 2,931,428 | 4/1960 | Dunlap | 431/189 |
| 3,047,240 | 7/1962 | Lent | 239/265 |
| 4,302,179 | 11/1981 | Pont | 431/189 |

FOREIGN PATENT DOCUMENTS

| | | | |
|---|---|---|---|
| 3701110 | 7/1988 | Fed. Rep. of Germany | 239/283 |

OTHER PUBLICATIONS

Combustion Tec, Inc., Bulletin No. 09AG.
Combustion Tec, Inc., Bulletin No. 09PG.
Combustion Tec, Inc., Bulletin No. 09ST-49.
Combustion Tec, Inc., Bulletin No. 09A-45.
Combustion Tec, Inc., Bulletin No. 09P-42.
Combustion Tec, Inc., Bulletin No. 09A-51.
"Underport Firing System for Glass Furnaces", Hotwork Inc., Hillside, N.J.

*Primary Examiner*—Randall L. Green
*Attorney, Agent, or Firm*—Thomas W. Speckman; Douglas H. Pauley

[57] ABSTRACT

A method and apparatus for adjusting horizontal, vertical, and horizontal and vertical angular positions of tubes without need to re-position an entire mounting bracket assembly or mounting bracket baseplate. Such adjustable mounting bracket assembly may be used for axial adjustment of a burner nozzle while maintaining a seal by a ball-and-socket joint located on a furnace wall.

17 Claims, 3 Drawing Sheets

BURNER BRACKET

BACKGROUND OF THE INVENTION

1. Field of the Invention

This invention relates to a simplified method and apparatus for adjusting horizontal, vertical, and combined horizontal and vertical angular positions of tubes, more particularly burner nozzles, having an open, spherically faced end mounted in a mating spherically faced mounting plate. Such adjusting requires only one vertical and/or horizontal adjustment to maintain a tightly sealed joint between the spherically faced mounting end and the mating spherically faced mounting plate thereby eliminating other vertical and/or horizontal adjustments of the bracket to maintain a tightly sealed joint.

2. Description of the Prior Art

Burner nozzles, used to inject fuel/air or other oxidizer mixtures into large industrial furnaces, such as glass melting furnaces, generally require some type of mounting bracket. Some mounting brackets used for these purposes have rigid construction with no practical means for position adjustment. Other mounting brackets have limited position adjustment capabilities. Combustion Tec, Inc., Orlando, Fla., Bulletin Nos. 09ST-49, 09A-45, 09P-42 and 09A-51, and the publication by Hotwork Inc., Hillside, N.J., entitled "Underport Firing Systems for Glass Furnaces", describe various types of mounting brackets for burner nozzles. Other mounting brackets for burner nozzles are quickly field designed and crudely installed by furnace users.

A poor seal between a burner nozzle and furnace wall can significantly reduce furnace efficiency. Inspirating air, cold air entering the furnace around the burner nozzle, may reduce furnace efficiency by up to about 5 percent. Poor seals which cause inspirating air around the burner nozzle often occur as a result of the mechanical procedure used to re-aim a burner nozzle. Many burner nozzles have a spherically faced or "ball" end that mates with a spherically grooved or "socket" mounting plate. The ball-and-socket arrangement forms a seal. Re-aiming burner nozzles equipped with ball-and-socket seals causes a change in the vertical, horizontal, both vertical and horizontal, or vertical and horizontal angular position of tubes or burner nozzles. Such re-aiming often requires at least two movements in existing mounting brackets. While the above problems have been described specifically with respect to burners and furnaces, the same situations are existent with any reactant introduction into any reactor system.

Existing mounting brackets accomplish vertical angular adjustments through the use of an adjustable arc mechanism such as those shown in Combustion Tec, Inc., Orlando, Fla., Bulletin Nos. 09ST-49 and 09P-42. However, a horizontal position adjustment of the same mounting bracket requires movement of the entire mounting bracket assembly. Re-aiming by adjusting the entire mounting bracket assembly causes a break in the seal between the burner nozzle and furnace wall and normally interrupts continuous burner service. Re-aiming or re-positioning a mounting bracket assembly according to this invention causes no break in the seal between the burner nozzle and furnace wall and thus does not interrupt continuous burner service.

SUMMARY OF THE INVENTION

Accordingly, an object of this invention is to provide an improved method and apparatus for adjusting the horizontal, vertical, and horizontal and vertical angular positions of mounted tubes or burner nozzles.

It is yet another object of this invention to provide a mounting bracket assembly for adjustment of horizontal and vertical angular positions of tubes or burner nozzles without requiring movement of the entire mounting bracket assembly or connected baseplate.

It is yet another object of this invention to provide adjustment of the horizontal, vertical, and horizontal and vertical angular positions of mounted tubes or burner nozzles sealed to a hole through the furnace wall without interrupting continuous burner service.

It is yet another object of this invention to provide adjustment of the horizontal, vertical, and horizontal and vertical angular positions of mounted tubes while simultaneously maintaining the seal of a ball-and-socket connection between a nozzle, such as a burner nozzle, and a wall opening, such as in a reactor or furnace wall, without creating inspirating air around the burner nozzle.

This invention provides a method and apparatus for independently or simultaneously adjusting horizontal, vertical, and horizontal and vertical angular positions of mounted tubes, more particularly mounted burner nozzles. According to one embodiment of this invention, an adjustable mounting bracket assembly for adjusting and securing horizontal, vertical, and horizontal and vertical angular positions of the axis of a tube, comprises a base having base horizontal adjusting means for adjusting and securing a horizontal position of the base with respect to ground and base vertical adjusting means for adjusting and securing a vertical and rotational position of the base with respect to the ground; gimbal bracket means extending from the base and holding gimbal means having two concentric gimbal rings, the outer gimbal ring pivotally attached to the gimbal bracket and the inner gimbal ring pivotally attached to the outer gimbal ring to pivot at 90° with respect to th pivot axis of the outer gimbal ring; a saddle supporting the tube at a position spaced from the gimbal rings and having longitudinal adjusting means for adjusting and securing the longitudinal position of the tube on the saddle, the tube fixedly retained within the inner gimbal ring; horizontal angular adjusting means having one side attached to the base and an adjustable second side attached to the saddle moving the saddle for adjusting and securing the horizontal angular position of the tube axis, and vertical angular adjusting means having one side attached to the base and an adjustable side attached to the saddle moving the saddle for adjusting and securing the vertical angular position of the tube axis. The terms "horizontal angular" and "vertical angular" as used throughout this description and claims generally refer to the horizontal and vertical components of an angular axis directed at an angle to both the horizontal and vertical axes.

While this invention is specifically described with respect to burners and furnaces for exemplification, it is to be recognized that it is suitable and applicable for adjusting and securing the horizontal, vertical, and horizontal and vertical angular positions of the axis of any tube, such as a feed line for any reactor vessel.

BRIEF DESCRIPTION OF THE DRAWINGS

The above objects and further advantages of this invention will become apparent by reference to the following description taken with specific embodiments of the apparatus of this invention shown in the drawing, wherein.

DESCRIPTION OF THE PREFERRED EMBODIMENTS

Figure 1:
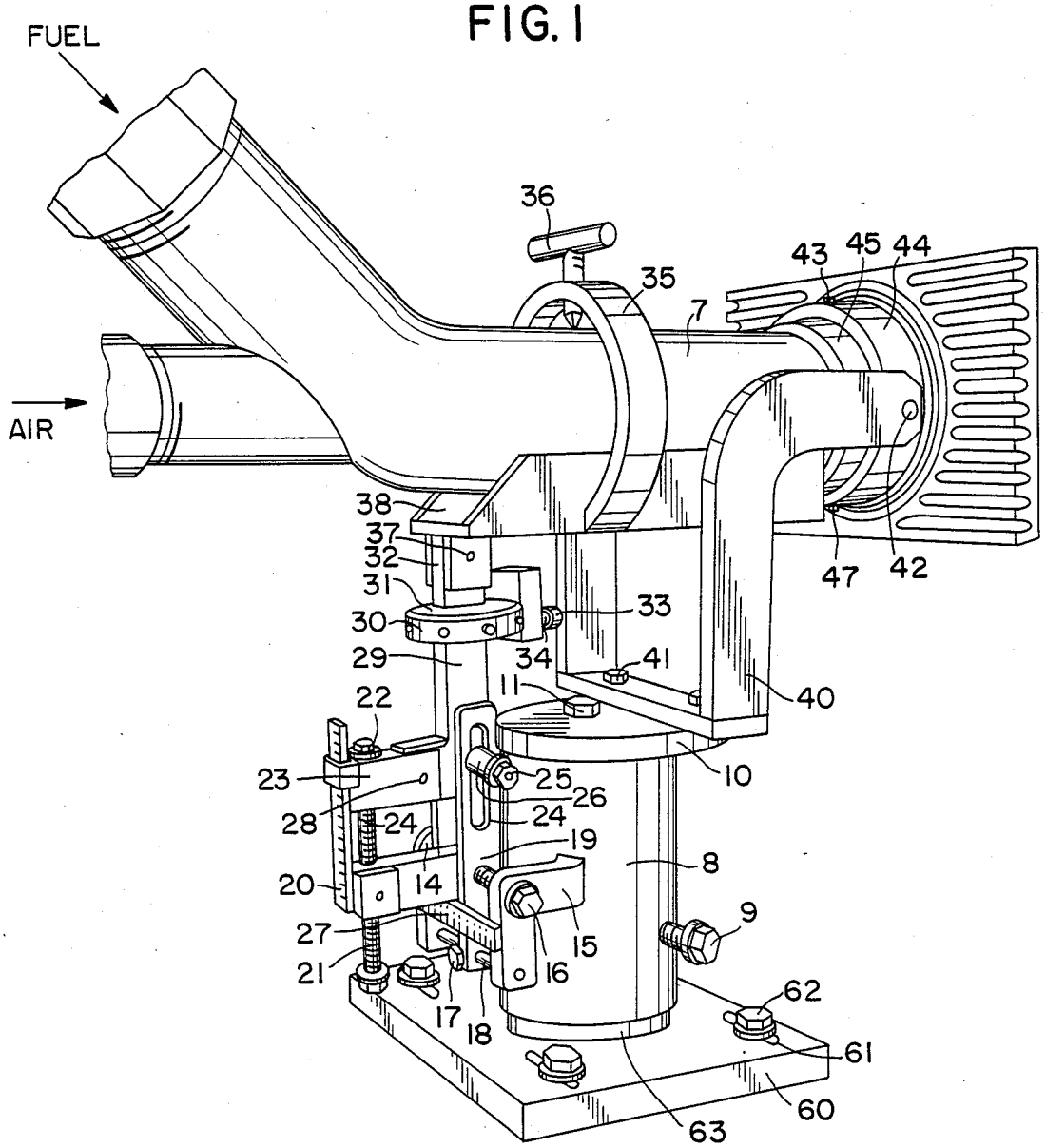
FIG. 1 shows a perspective view of an adjustable mounting bracket assembly according to one embodiment of this invention.
Figure 2:
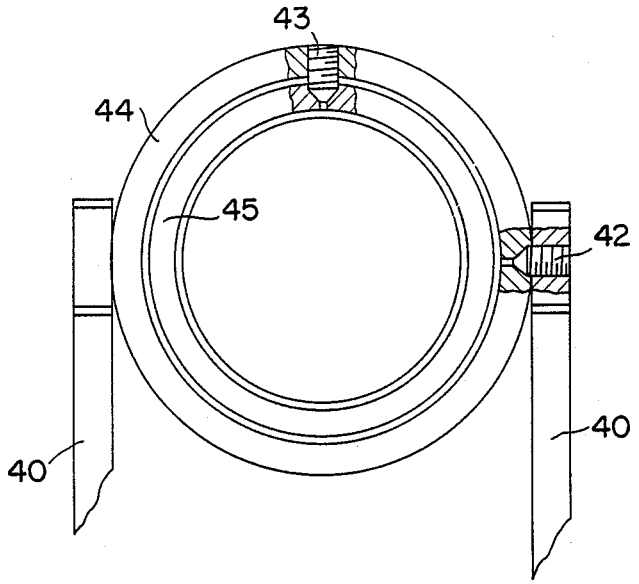
FIG. 2 shows a partial cross-sectional front view of a gimbal bracket assembly as shown in FIG. 1.
Figure 4:
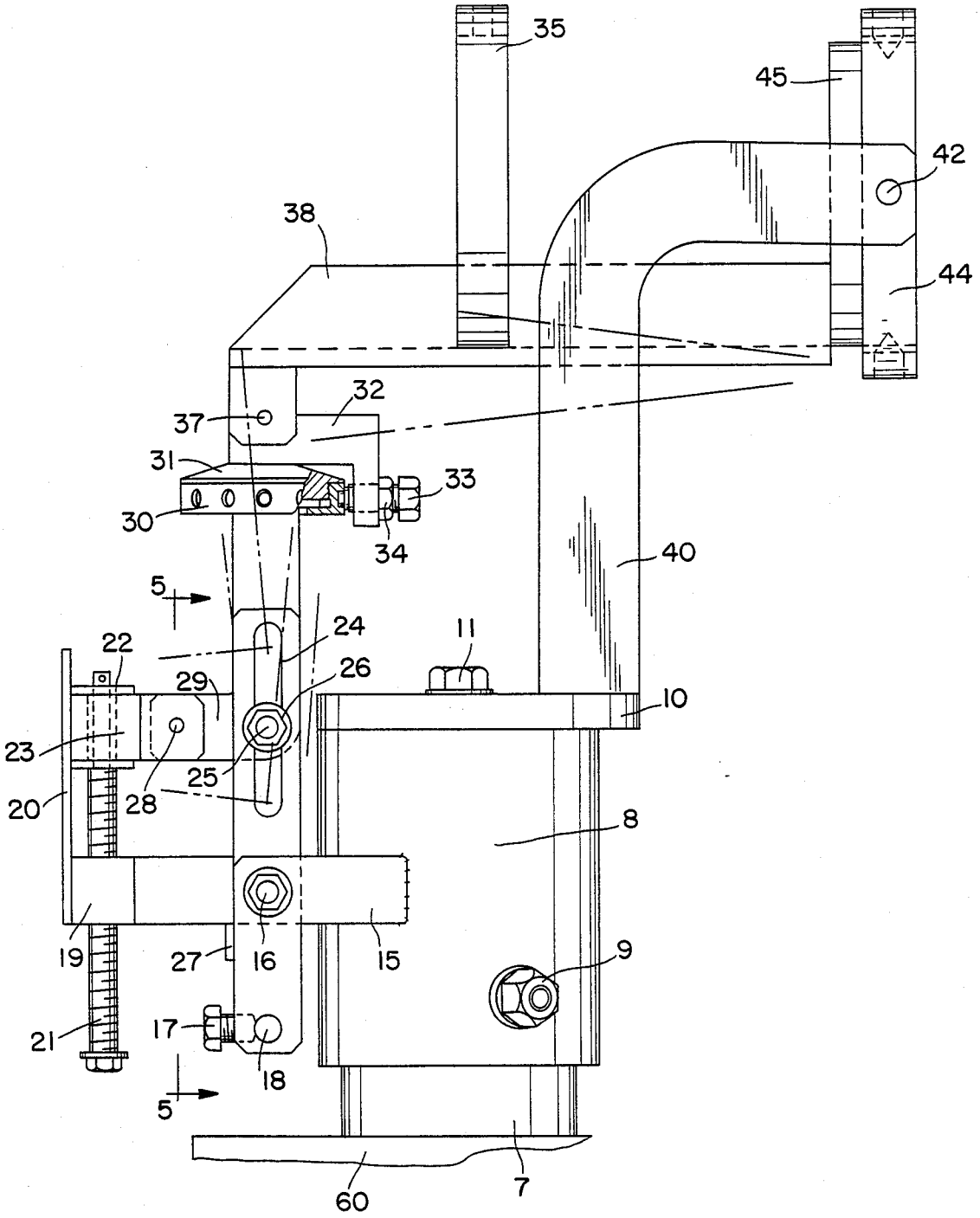
FIG. 4 shows a partial cross-sectional side view of an adjustable mounting bracket assembly as shown in FIG. 1.

FIGS. 1 and 4 show an adjustable mounting bracket assembly according to one embodiment of this invention. Baseplate 60 has slotted mounting holes 61 forming the horizontal adjusting means of nozzle tube 7. Screws or bolts 62 fit through the slotted holes of baseplate 60 and secure baseplate 60 to ground or another stationary object. The terminology "ground" as used throughout this description and claims refers to both the ground or any other stationary object with respect to the furnace, such as a factory floor. It is apparent that other mechanical elemental configurations using C-clamps, various multiple slotted holes, sliding lockable elements and the like, can combine to form the horizontal adjusting means.

Inner sleeve 63 fixedly attaches to baseplate 60 forming part of a vertical adjusting means. Outer sleeve 8 has an inside diameter slightly larger than the outside diameter of inner sleeve 63 and fits over inner sleeve 63 thus allowing outer sleeve 8 to rotate and be adjusted vertically relative to inner sleeve 63. Plate 10 fixedly attaches to the upper end of outer sleeve 8. Bolt 11 extends through plate 10 and into an internally threaded tube sleeve attached to baseplate 60. Bolt 11 has a securing means, such as a washer fixedly attached to bolt 11 and adjacent the bottom surface of plate 10, for fixing the vertical position of bolt 11 relative to plate 10 such that rotating bolt 11 causes vertical displacement of outer sleeve 8.

Setscrew 9, preferably in two locations, threads through the wall of outer sleeve 8 and sets against the outside surface of inner sleeve 63 locking the position of outer sleeve 8 relative to inner sleeve 63. The vertical displacement of the centerline axis of nozzle 7 can be adjusted by loosening setscrews 9, rotating bolt 11 and then tightening setscrews 9. It is apparent that other elemental configurations such as hydraulic pistons, mechanical jacks, and the like can combine to form the vertical adjusting means.

The horizontal adjusting means and the vertical adjusting means structure make up the base of the adjustable mounting bracket assembly.

Mounting brackets 14 and 15 fixedly attach to outer sleeve 8. One end of scale 27 is connected to mounting bracket 14 and the opposite end of scale 27 is connected to mounting bracket 15. Scale 27 is used to determine the horizontal component of the horizontal angular displacement of nozzle 7. Scale 27 i positioned such that the calibrated marks on scale 27 face away from outer sleeve 8. Rod 18 extends from a hole in the lower portion of mounting bracket 14 through a hole in the lower portion of positioning bracket 19 to a hole in the lower portion of mounting bracket 15. Setscrew 17 threads through the front face of positioning bracket 19 and can lock against rod 18.

Figure 5:
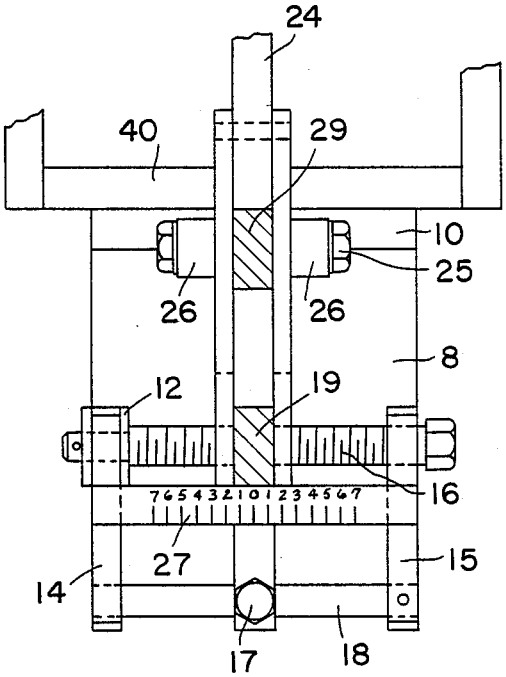
FIG. 5 shows a partial cross-sectional front view, along line 5—5 shown in FIG. 4, of a positioning bracket as shown in FIG. 1.

As shown in FIG. 1 and FIG. 5, horizontal angular adjustment bolt 16 has one hex end adjacent a non-threaded shoulder. Such non-threaded shoulder rotatably fits inside a through hole located in the upper portion of mounting bracket 15. Further adjacent such non-threaded shoulder, horizontal angular adjustment bolt 16 has a threaded portion extending from the inner side of mounting bracket 15 through a threaded hole in the lower portion of positioning bracket 19 and further extending as far as the inner face of positioning sleeve 12, located against the inner side of mounting bracket 14. The opposite end of horizontal angular adjustment bolt 16 has a smooth end extending rotatably through positioning sleeve 12. The pinned end of horizontal angle adjustment bolt 16 is held in place by a shear pin, retaining clip or the like.

Rotating horizontal angular adjustment bolt 16 causes horizontal displacement of horizontal positioning bracket 19. Horizontal positioning bracket 19 slides along rod 18 and setscrew 17 locks positioning bracket 19 into a desired position. Displacement of horizontal positioning bracket 19 causes horizontal displacement of the end, opposite gimbal rings 44 and 45, of nozzle saddle 38. Horizontal displacement of such end of nozzle saddle 38 causes horizontal angular displacement of the centerline of inlet nozzle 7. After obtaining a desired horizontal angular displacement as indicated on scale 27, locking setscrew 17 against rod 18 secures the horizontal angular displacement of nozzle 7.

In a preferred embodiment of this invention, horizontal positioning bracket 19, horizontal angular adjustment bolt 16 and rod 18 are the basic elements that form the horizontal angular adjusting means. It is apparent that other various mechanical elemental configurations such as hydraulically operated piston assemblies, mechanical jack assemblies and the like, can combine to form the horizontal angular adjusting means.

Vertical angular adjusting bolt 21 has one hex end adjacent a threaded portion which vertically extends upward through a threaded hole in a front portion of positioning bracket 19. The threaded portion of vertical angle adjusting bolt 21 extends upward as far as the lower face of positioning sleeve 22. The opposite end of vertical angle adjusting bolt 21 has a pinned end which rotatably fits into positioning sleeve 22 The pinned end of vertical angle adjusting bolt 21 and the through hole of positioning sleeve 22 have non-threaded smooth surfaces. The pinned end of vertical angle adjusting bolt 21 is held in place by a shear pin, retaining clip or the like.

The bottom portion of scale 20 fixedly attaches to the front of horizontal positioning bracket 19. The upper portion of scale 20 freely slides through a guide bracket which is an attached portion of positioning bracket 23. Rotating vertical angular adjusting bolt 21 engages the threads of vertical angle adjusting bolt 21 with the through hole threads in the front portion of horizontal positioning bracket 19 causing vertical displacement of positioning bracket 23. Rotating vertical angular adjusting bolt 21 engages the threads of vertical angle adjusting bolt 21 with the through hole threads in the front portion of horizontal positioning bracket 19 causing vertical displacement of positioning bracket 23. Rotating vertical angular adjusting bolt 21 engages the threads of vertical angle adjusting bolt 21 with the through hole threads in the front portion of horizontal positioning bracket 19 causing vertical displacement of positioning bracket 23. Vertical displacement of positioning bracket 23 causes vertical displacement of the end, opposite gimbal rings 44 and 45, of nozzle saddle 38. Vertical displacement of such end of nozzle saddle 38 causes vertical angular displacement of the centerline of inlet nozzle 7.

Pin 28 rotatably fits inside through holes in positioning brackets 23 and 29. The pin 28 joint allows positioning bracket 23 to pivot with respect to vertical positioning bracket 29. Bolt 25 extends through spacer 26, horizontal positioning bracket 19, and slotted opening 24 in vertical positioning bracket 29. Spacer 26 provides easy tool access to the head of bolt 25. Loosening bolt 25 allows adjustment of vertical positioning bracket 29. Tightening bolt 25 locks vertical positioning bracket 29 in a desired position.

In a preferred embodiment of this invention, positioning bracket 23, vertical angular adjusting bolt 21 and vertical positioning bracket 29 with bolt 25 are the basic elements that combine to form the vertical angular adjusting means. It is apparent that other various mechanical elemental configurations such as hydraulically operated piston assemblies, mechanical jack assemblies, and the like, can combine to form the vertical angular adjusting means.

Figure 3:
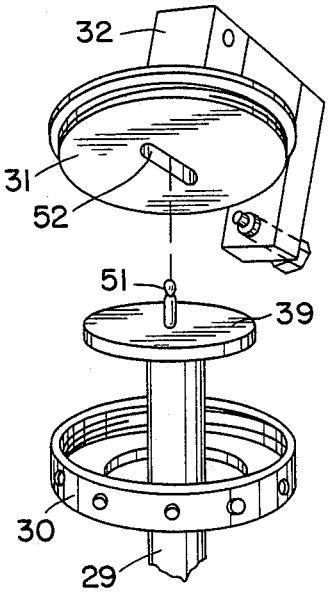
FIG. 3 shows a perspective unassembled view of a retaining ring assembly as shown in FIG. 1.

FIG. 3 shows a perspective dissassembled view of a retaining ring assembly according to one embodiment o this invention. Disc plate 39 fixedly attaches to the top of vertical positioning bracket 29. Retaining ring 30 seats against the bottom face of disc plate 39. Slotted groove 52, located in the center portion of disc plate 31, fits over pin 51. Pin 51 attaches to disc plate 39 at the center of disc plate 39. Positioning bracket 32 attaches to the top of disc plate 31. Pinned setscrew 33 extends through an overhang portion of positioning bracket 32. Lock nut 34, located between positioning bracket 32 and the nut end of pinned setscrew 33, locks pinned setscrew 33 in an adjusted position. The retaining ring assembly allows positioning bracket 32 to rotate 360° with respect to vertical positioning bracket 29.

The outer side of retaining ring 30 has a plurality of circumferentially spaced holes which, in the assembled position of retaining ring 30 and disc plate 31, mate with the pinned end of pinned setscrew 33. Mating pinned setscrew 33 with a hole in retaining ring 30 vertically secures positioning bracket 32 with respect to positioning bracket 29. Retaining ring 30, disc plate 31 and pinned setscrew 33 are the basic elements that form means for positioning bracket 32 to rotate about its vertical axis with respect to vertical positioning bracket 29. However, it is apparent that other various mechanical elements such as torsionally flexible brackets, swivel joints and the like can combine to form means for positioning bracket 32 to rotate about its vertical axis with respect to positioning bracket 29.

The rear end, away from the open end of nozzle 7, of nozzle saddle 38 pivotally connects to positioning bracket 32 at pin 37. The opposite front end, adjacent the open end of nozzle 7, of nozzle saddle 38 connects to inner gimbal ring 45. The lower portion of nozzle clamp ring 35 fixedly attaches to the base of nozzle saddle 38. Setscrew 36 extends through the top of nozzle clamp ring 35 to hold nozzle 7 firmly in nozzle saddle 38. The joint at pin 37 allows nozzle saddle 38 to pivot with respect to positioning bracket 32.

Thus, horizontal angular adjusting means has one side attached to the base and an adjustable second side attached to the saddle moving the saddle for adjusting and securing the horizontal angular position of the tube axis, and the vertical angular adjusting means has one side attached to the base and an adjustable second side attached to the saddle moving the saddle for adjusting and securing the vertical angular position of the tube axis.

Bolt 41 (two places) fixedly attaches gimbal bracket 40 to plate 10. It is apparent that other methods such as welding, rivets, several bolting arrangements, a one-piece plate 10 and gimbal bracket 40, and the like, can be used to fixedly attach gimbal bracket 40 with respect to plate 10. Pivot screw 42 (two places) extends through a threaded hole in holding bracket 40 and into outer gimbal ring 44. Pivot screw 42 (two places) allows outer gimbal ring 44 to pivot with respect to gimbal bracket 40. Pivot screw 43 (two places) extends through outer gimbal ring 44 and into inner gimbal ring 45. Pivot screw 43 (two places) allows inner gimbal ring 45 to pivot about an axis at 90° with respect to the pivot axis of outer gimbal ring 44.

Nozzle saddle 38 supports nozzle 7 which fits inside of nozzle clamp ring 35. Tightening setscrew 36 secures nozzle 7 with respect to nozzle saddle 38. The ball-type end of nozzle 7 extends through inner gimbal ring 45 and seals with a mating socket plate, normally mounted, for example, in a furnace wall. The ball-type nozzle end and socket plate must properly mate, by means known to the art for such seals, in order to form a seal which prevents leakage into a reactor or furnace. Varying the aim of an inlet nozzle, such as a furnace fuel/air nozzle may be necessary under varying furnace conditions to provide continuing high furnace efficiency. The burner bracket of this invention provides for mechanical adjustments for desired horizontal and vertical positioning of a nozzle in a sealed socket opening in a furnace wall while varying the axial nozzle positions as desired and without breaking of the burner seal with the furnace wall.

A jig can be used to initially align the adjustable mounting bracket assembly. The jig is positioned within nozzle saddle 38 and aligned to ensure that a correct distance exists between the spherically faced mounting plate and the pivot point of the gimbal rings. Initial alignment with such jig is an important aspect of this invention since it determines the accuracy with which burner nozzle 7 can be adjusted while maintaining a sealed-in firing condition. In such initial alignment, the gimbal rings 44 and 45 must be positioned to align the centers of the radius of the spherically faced mounting end of nozzle 7 and the mating spherically faced mounting plate. Once the initial alignment has been achieved, base plate 60 is secured and remains fixed with respect to ground or another structural member attached to ground. After the initial alignment position has been secured, the angular displacement of nozzle 7 in both the horizontal and vertical planes can be accomplished while maintaining a sealed-in firing condition by rotating the adjusting bolt 21 assembly and/or the adjusting bolt 16 assembly.

The above description of one embodiment of this invention includes a means for adjusting the angular displacement in both the horizontal and vertical planes. Another embodiment of this invention provides means for adjusting the angular displacement in only the horizontal plane. Such embodiment eliminates the adjusting bolt 21 assembly and replaces positioning brackets 19 and 29 with one rigid positioning bracket. Yet another embodiment of this invention provides means for adjusting only the vertical angular displacement. Such embodiment eliminates the adjusting bolt 16 assembly, eliminates mounting brackets 14 and 15, and replaces positioning bracket 19 with one rigid support bracket attached at one end to outer sleeve 8. Such limited embodiments reduce the cost of the mounting bracket of this invention for users who do not require angular displacement of a tube or burner nozzle directions having in both vertical and horizontal vectors.

The burner bracket of this invention may be fabricated from materials well known to the art, such as various steels, as will be readily apparent to one skilled in the art. Specific materials for various components may be selected according to size, strength, temperature requirements and do not form a part of this invention.

This invention includes a method for adjusting and securing horizontal, vertical, and horizontal and vertical angular positions of the axis of a tube by the steps: adjusting and securing a horizontal position of a base with respect to ground and adjusting and securing a vertical and rotational position of the base with respect to ground; adjusting and securing one of a horizontal angular adjusting means having one side attached to the base and an adjustable second side attached to a saddle moving the saddle for adjusting and securing the horizontal angular position of the tube axis and a vertical angular adjusting means having one side attached to the base and an adjustable second side attached to the saddle moving the saddle for adjusting and securing the vertical angular position of the axis of the tube, the tube fixedly retained within an inner gimbal ring toward one end of the tube, the inner gimbal ring pivotally attached to an outer gimbal ring to pivot at 90° with respect to the pivot axis of the outer gimbal ring, the outer gimbal ring pivotally attached to a gimbal bracket extending from the base, and the tube supported on the saddle at position spaced from the gimbal rings by longitudinal adjusting means for adjusting and securing the longitudinal position of the tube on the saddle. In a preferred method, both the horizontal and the vertical angular adjusting means are adjusted and secured to provide the tube at an angle having both horizontal and vertical components.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An adjustable mounting bracket assembly for adjusting and securing horizontal, vertical, and horizontal and vertical angular positions of the axis of a tube, comprising:

a base comprising base horizontal adjusting means for adjusting and securing a horizontal position of said base with respect to ground and base vertical adjusting means for adjusting and securing a vertical and rotational position of said base with respect to said ground;

gimbal bracket means extending from said base and holding gimbal means comprising two concentric gimbal rings, the outer said gimbal ring pivotally attached to said gimbal bracket and the inner said gimbal ring pivotally attached to said outer gimbal ring to pivot at 90° with respect to the pivot axis of said outer gimbal ring;

a saddle supporting said tube at a position spaced from said gimbal rings and comprising longitudinal adjusting means for adjusting and securing the longitudinal position of said tube on said saddle, said tube fixedly retained within said inner gimbal ring toward one end of said tube; and horizontal angular adjusting means having one side attached to said base and an adjustable second side attached to said saddle moving said saddle for adjusting and securing said horizontal angular position of said tube axis, and vertical angular adjusting means having one side attached to said base and an adjustable second side attached to said saddle moving said saddle for adjusting and securing said vertical angular position of said axis of said tube.

2. An adjustable mounting bracket according to claim 1 wherein said base comprises a flat baseplate having slots for receiving tigthening screws for said adjusting and securing said horizontal position of said base.

3. An adjustable mounting bracket according to claim 2 wherein said base comprises an inner sleeve fixedly attached to said baseplate, an outer sleeve slidably engageable over said inner sleeve, and holding means securing a vertical and rotary position of said outer sleeve relative to said inner sleeve.

4. An adjustable mounting bracket according to claim 3 wherein said horizontal angular adjusting means comprises a mounting bracket extending outwardly from said outer sleeve, an angular positioning bracket attached to said saddle, a horizontal adjustment bolt rotably mounted on one of said mounting bracket and said positioning bracket and threadedly engaged with the other of said mounting bracket and said positioning bracket, whereby rotation of said horizontal angular adjustment means causes horizontal pivoting of said saddle and said tube about said gimbal means.

5. An adjustable mounting bracket according to claim 4 wherein a horizontal scale is attached to one of said brackets and the other of said brackets moves along said horizontal scale.

6. An adjustable mounting bracket according to claim 3 wherein said vertical angular adjusting means comprises a mounting bracket extending outwardly from said outer sleeve, an angular positioning bracket attached to said saddle, a vertical adjustment bolt rotably mounted on one of said mounting bracket and said positioning bracket and threadedly engaged with the other of said mounting bracket and said positioning bracket, whereby rotation of said vertical angular adjustment means causes vertical pivoting of said saddle and said tube about said gimbal means.

7. An adjustable mounting bracket according to claim 6 wherein a vertical scale is attached to one of said brackets and the other of said brackets moves along said vertical scale.

8. An adjustable mounting bracket according to claim 3 wherein said horizontal angular adjusting means comprises a mounting bracket extending outwardly from said outer sleeve an angular positioning bracket attached to said saddle, a horizontal adjustment bolt rotably mounted on one of said mounting bracket and said positioning bracket and threadedly engaged with the other of said mounting bracket and said positioning bracket, whereby rotation of said horizotnal angular adjustment means causes horizontal pivoting of said saddle and said tube about said gimbal means and said vertical angular adjusting means comprises a mounting bracket extending outwardly from said outer sleeve, an angular positioning bracket attached to said saddle, a vertical adjustment bolt rotably mounted on one of said mounting bracket and said positioning bracket and threadedly engaged with the other of said mounting bracket and said positioning bracket, whereby rotation of said vertical angular adjustment means causes vertical pivoting of said saddle and said tube about said gimbal means.

9. An adjustable mounting bracket according to claim 8 wherein a horizontal scale is attached to one of said brackets and the other of said brackets moves along said horizontal scale and a vertical scale is attached to one of said brackets and the other of said brackets moves along said vertical scale.

10. An adjustable mounting bracket according to claim 8 wherein said angular positioning bracket is pivotally attached to said saddle.

11. An adjustable mounting bracket according to claim 10 wherein said tube is a burner nozzle tube having a ball-type nozzle end sealingly engaged with a socket plate in a furnace wall.

12. An adjustable mounting bracket according to claim 1 wherein said tube is a burner nozzle tube having a ball-type nozzle end sealingly engaged with a socket plate in a furnace wall.

13. An adjustable mounting bracket according to claim 1 wherein said angular positioning bracket is pivotally attached to said saddle.

14. A method for adjusting and securing horizontal, vertical, and horizontal and vertical angular positions of the axis of a tube, comprising:

adjusting and securing a horizontal position of a base with respect to ground and adjusting and securing a vertical and rotational position of said base with respect to said ground;

adjusting and securing one of a horizontal angular adjusting means having one side attached to said base and an adjustable second side attached to a saddle moving said saddle for adjusting and securing said horizontal angular position of said tube axis and a vertical angular adjusting means having one side attached to said base and an adjustable second side attached to said saddle moving said saddle for adjusting and securing said vertical angular position of said axis of said tube, said tube fixedly retained within an inner gimbal ring toward one end of said tube, said inner gimbal ring pivotally attached to an outer gimbal ring to pivot at 90° with respect to the pivot axis of said outer gimbal ring, said outer gimbal ring pivotally attached to a gimbal bracket extending from said base, and said tube supported on said saddle at a position spaced from said gimbal rings by longitudinal adjusting means for adjusting and securing the longitudinal position of said tube on said saddle.

15. A method according to claim 14 comprising adjusting and securing both said horizontal nd said vertical angular adjusting means.

16. A method according to claim 15 wherein said tube is a burner nozzle tube having a ball-type nozzle end sealingly engaged with a socket plate in a furnace wall.

17. A method according to claim 14 wherein said tube is a burner nozzle tube having a ball-type nozzle end sealingly engaged with a socket plate in a furnace wall.

* * * * *